US006823168B2

(12) United States Patent
Sakuma

(10) Patent No.: US 6,823,168 B2
(45) Date of Patent: Nov. 23, 2004

(54) SHEET PROCESSING APPARATUS AND SHEET TRANSPORTING DEVICE

(75) Inventor: Akira Sakuma, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/382,621

(22) Filed: Mar. 7, 2003

(65) Prior Publication Data

US 2004/0047664 A1 Mar. 11, 2004

(30) Foreign Application Priority Data

Sep. 5, 2002 (JP) ..... P2002-259842

(51) Int. Cl.[7] ..... G03G 15/00
(52) U.S. Cl. ..... 399/405; 399/110; 399/397
(58) Field of Search ..... 399/107, 110, 399/397, 405, 407

(56) References Cited

U.S. PATENT DOCUMENTS 5,073,801 A * 12/1991 Haneda et al. ..... 399/45
5,379,101 A * 1/1995 Takahashi et al. ..... 399/110
5,946,541 A * 8/1999 Kakigi ..... 399/405
6,128,463 A * 10/2000 Matsumoto et al. ..... 399/364
6,263,185 B1 * 7/2001 Kato et al. ..... 399/381
6,314,267 B1 * 11/2001 Kida ..... 399/405
6,473,579 B1 * 10/2002 Suzuki et al. ..... 399/124
6,647,243 B2 * 11/2003 Sato et al. ..... 399/407
6,690,901 B2 * 2/2004 Katsuyama et al. ..... 399/107

FOREIGN PATENT DOCUMENTS

JP 10-69137 3/1998

* cited by examiner

*Primary Examiner*—Andrew H. Hirshfeld
*Assistant Examiner*—Dave A. Ghatt
(74) *Attorney, Agent, or Firm*—Morgan, Lewis & Bockius LLP

(57) ABSTRACT

A sheet processing apparatus has, in the upper portion of an apparatus main body, a main body discharge section and a main body stack section in which a sheet discharged from the main body discharge section is placed. The sheet processing apparatus includes a transport section disposed on the upper portion of the main body stack section and transports the sheet discharged from the main body discharge section in a sheet eject direction, an eject section which is disposed on the upper portion of the main body discharge section and from which the sheet with an image formed thereon is ejected through a eject passage different from the eject passage of the main body discharge section, and a transport placement portion which is disposed on the transport section and in which the sheet ejected from the eject section is placed.

7 Claims, 7 Drawing Sheets

SHEET PROCESSING APPARATUS AND SHEET TRANSPORTING DEVICE

The present disclosure relates to the subject matter contained in Japanese Patent Application No. 2002-259842 filed Sep. 5, 2002, which is incorporated herein by reference in its entirety.

BACKGROUND OF THE INVENTION

1. Field of the Invention

The present invention relates to a sheet processing apparatus for processing a sheet such as a copying machine or a printer, particularly to an improved sheet processing apparatus capable of coping with additional provision of a postprocessing apparatus, and an improved sheet transporting device used with the sheet processing apparatus.

2. Description of the Related Art

As a conventional sheet processing apparatus, for example, as shown in FIG. 6, there is known a sheet processing apparatus structured such that an image forming section (not shown) of an electrophotographic type is disposed inside an apparatus main body 200, a main body discharge section for discharging a sheet S on which an image is formed (for example, a structure including a pair of eject rollers in the vicinity of the exit of a eject passage) and a main body stack section (eject tray) 202 for placing and storing therein the sheet S discharged from the main body discharge section 201 are disposed in the upper portion of the apparatus main body 200.

The thus structured sheet processing apparatus, when compared with an apparatus of a type in which a eject tray is disposed on the lateral side of the apparatus main body 200, has an advantage that the installation space of the apparatus is reduced.

However, some users may wish to expand the system of the sheet processing apparatus, in which the eject tray 202 is disposed in the upper portion of the apparatus main body 200. For example, some users wish to add a postprocessing apparatus 210 incorporating therein a postprocessing unit such as a sorter, a stapler and a puncher.

Under such requests, if the postprocessing apparatus 210 is simply add to the lateral side of the apparatus main body 200, the sheet S with an image formed in the image forming section of the apparatus main body 200 side cannot be delivered into the postprocessing apparatus 210 side.

Therefore, conventionally, as shown in FIG. 6, there has been already proposed a technique in which the sheet S discharged from the main body discharge section 210 is transported to the postprocessing apparatus 210 side by a transport unit 220, while a stack portion 221 formed on the transport unit 220 is used to serve as a eject tray, whereby the sheet S can be ejected to the stack portion 221 (for example, see JP-A-10-69137 (pages 3 to 4, FIG. 1)).

Here, the transport unit 220 comprises a stack portion 221 on which the sheet S to be discharged from the main body discharge section 201 can be placed and stored, a stacking eject portion 222 (for example, a pair of eject rollers) for transporting the sheet S discharged from the main body discharge section 201 to the stack portion 221, a postprocessing transport portion 223 (for example, a plurality of transport rollers) disposed in the lower space of the stack portion 221 for transporting the sheet S discharged from the main body discharge section 201 to the postprocessing apparatus 210 side, and a switching gate 224 for switching the transport direction of the sheet S discharged from the main body discharge section 201 to the stacking eject portion 222 side or to the postprocessing transport portion 223 side.

However, in the transport unit 220 of the sheet processing apparatus of the above type, since the switching gate 224 and stacking eject portion 222 must be disposed downstream of the main body discharge section 201, it is indispensable to secure a space for provision of the switching gate 224 and stacking eject portion 222 within the transport unit 220. This raises a technical problem, that is, the dimension L of the sheet that can be placed in the stack portion 221 formed on the transport unit 220 is restricted ($L<L0$, where L0 is the sheet dimension that can be placed on the main body stack section 202).

Also, in the transport unit 220, a transport passage (stack side transport passage) 225, which is branched to the stacking eject passage 222 side by the switching gate 224, branches with a given value of curvature with respect to a transport passage (a postprocessing side transport passage) 226 that goes to the postprocessing transport portion 223. In case where the large curvature of the stack side transport passage 225 is to be secured, as shown by a one-dot chained line in FIG. 7, the length dimension L of the stack portion 221 (the dimension of the sheet that can be placed) can be secured so as to be large to a certain degree. However, depending on the kinds of sheets, there arises a technical problem that a sheet such as a thick sheet cannot be transported.

In view of this, in case where the curvature of the stack side transport passage 225 is set so as to be small to a certain degree, as shown by a two-dot chained line, when the length dimension L of the stack portion 221 is to be secured so as to be large to a certain degree, the storage quantity h1 of sheets S decreases. And, as shown by a solid line in FIG. 7, when the storage quantity h2 of sheets S is secured so as to be large to a certain degree, there arises a technical problem that the length dimension L1 of the stack portion 221 is restricted extremely.

SUMMARY OF THE INVENTION

The present invention aims at solving the above-mentioned technical problems found in the conventional sheet processing apparatus. Accordingly, it is an object of the invention to provide a sheet processing apparatus which can cope with a system expansion condition such as additional provision of a postprocessing apparatus and can secure sufficient sheet placement performance (sheet transportability, and space) on the upper portion of the apparatus main body, and a sheet transporting device used in the sheet processing apparatus.

In attaining the above object, according to a first aspect of the invention, there is provided a sheet processing apparatus comprising: an apparatus main body; an image forming section disposed in the apparatus main body; a main body discharge section, from which a sheet with an image formed thereon is discharged, disposed in the upper portion of the apparatus main body; a main body stack section, in which the sheet discharged from the main body discharge section is placed and stored, disposed in the upper portion of the apparatus main body; a transport section disposed on the upper portion of the main body stack section for transporting the sheet discharged from the main body discharge section in a sheet eject direction on the upper portion of the main body stack section; an eject section disposed on the upper portion of the main body discharge section for ejecting the sheet with an image formed thereon through a second eject passage different from a eject passage of the main body discharge section; and a transport placement portion formed on the upper portion of the transport section for placing and storing therein the sheet ejected from the eject section.

According to a second aspect of the invention, there is provided a sheet processing apparatus comprising: an apparatus main body; an image forming section disposed in the apparatus main body; a main body discharge section, from which a sheet with an image formed thereon is discharged, disposed in the upper portion of the apparatus main body; a main body stack section, in which the sheet discharged from the main body discharge section is placed and stored, disposed in the upper portion of the apparatus main body; a transport section disposed on the upper portion of the main body stack section for transporting the sheet discharged from the main body discharge section in a sheet eject direction on the upper portion of the main body stack section; an eject section disposed on the upper portion of the main body discharge section for ejecting the sheet with an image formed thereon; and a transport placement portion formed on the upper portion of the transport section for placing and storing therein the sheet ejected from the eject section, wherein the allowable quantity of sheets to be placed in the transport placement portion is larger than that of the main body stack section.

According to a third aspect of the invention, there is provided a sheet transporting device to be mounted on a sheet processing apparatus having an apparatus main body; an image forming section disposed in the apparatus main body; a main body discharge section, from which a sheet with an image formed thereon is discharged, disposed in the upper portion of the apparatus main body; and a main body stack section, in which the sheet discharged from the main body discharge section is placed and stored, disposed in the upper portion of the apparatus main body, the sheet transporting device comprising: a transport section disposed on the upper portion of the main body stack section for transporting the sheet discharged from the main body discharge section in a sheet eject direction on the upper portion of the main body stack section; an eject section disposed on the upper portion of the main body discharge section for ejecting the sheet with an image formed thereon through a second eject passage different from a eject passage of the main body discharge section; and a transport placement portion formed on the upper portion of the transport section for placing and storing therein the sheet ejected from the eject section.

DESCRIPTION OF THE INVENTION

Figure 1:
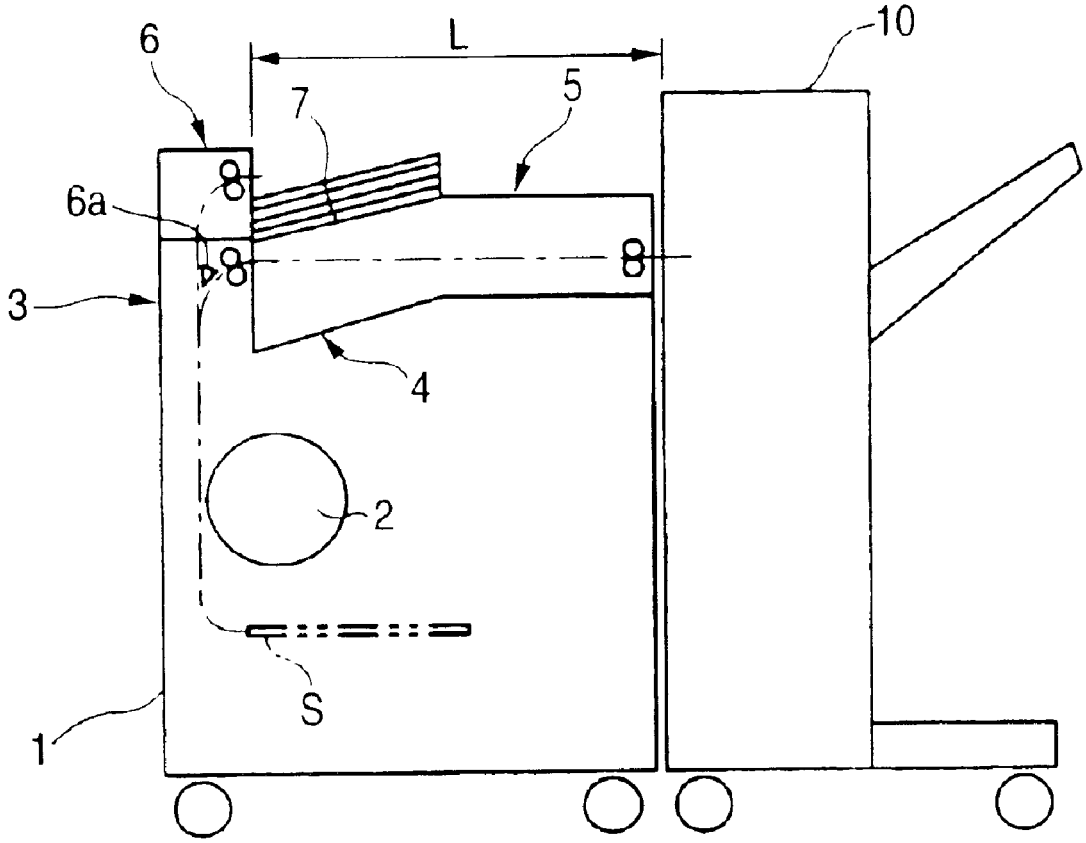
FIG. 1 is an explanatory view of a sheet processing apparatus and a sheet transporting device used with the sheet processing apparatus according to the invention.

As shown in FIG. 1, there is provided a sheet processing apparatus comprising, in the interior of an apparatus main body 1, an image forming section and, in the upper portion of the apparatus main body 1, a main body discharge section 3 from which a sheet S with an image formed thereon is to be discharged and a main body stack section 4 in which the sheet discharged from the main body discharge section 3 is to be placed and stored, the sheet processing apparatus further including: a transport section 5 disposed on the upper portion of the main body stack section 4 for transporting the sheet discharged from the main body discharge section 3 in a sheet eject direction on the upper portion of the main body stack section 4; an eject section 6 disposed on the upper portion of the main body discharge section 3 for ejecting the sheet S with an image formed thereon through a second eject passage different from the eject passage of the main body discharge section 3; and a transport placement portion 7 formed on the upper portion of the transport section for placing and storing therein the sheet S ejected from the eject section 6.

In short, the invention relates to a sheet processing apparatus that includes, as the expanding means when expanding the function thereof, the transport section 5 and the eject section 6.

As a typical example of a function expanded embodiment of the sheet processing apparatus, there can be taken an embodiment in which a postprocessing apparatus 10 that is used to enforce a given postprocessing on the sheet S transported by the transport section 5 is disposed on the lateral side of the apparatus main body 1.

Here, as the postprocessing apparatus 10, there can be selected any one postprocessing apparatus, provided that it can enforce various postprocessings such as a sorting processing, staple processing, a punch processing and a decoloring processing.

In the present technical means, the apparatus main body 1 may include the image forming section 2 formed therein. And, as the image forming type of the image forming section 2, there may be selected any one of an electrophotographic type, an electrostatic recording type and an ink jet type; and, there can be used either an image forming type capable of forming a black and white image or an image forming type capable of forming a color image.

Also, the main body discharge section 3 may be formed in the upper portion of the apparatus main body 1; and, it may include a eject passage for the sheet S on which an image has been formed in the image forming section 2, and a eject portion such as a pair of eject rollers formed in the exit of the eject passage. And, the main body discharge section 3 may be formed integrally with the apparatus main body 1 or may be formed separately from the apparatus main body 1.

Further, the main body stack section 4 may be formed in such portion of the upper portion of the apparatus main body 1 that the sheet S discharged from the main body discharge section 3 can be placed on; and, the main body stack section 4 may be formed integrally with the apparatus main body 1 or may be formed separately from the apparatus main body 1.

Also, according to the invention, the transport section 5 and an eject section 6 may be previously formed as a unit, or may be formed separately from each other so that they can be mounted independently.

And, in an embodiment in which the transport section 5 and an eject section 6 are used as a unit, they are normally formed as separate parts. However, they may also be formed as an integrated body.

Further, it is not essential that the transport section 5 and the eject section 6 are detachably mounted on the upper portion of the apparatus main body. They may be simply put on the upper portion of the apparatus main body.

Therefore, the invention includes an embodiment in which, when the sheet processing apparatus is shipped from a factory, the transport section 5 and an eject section 6 are previously assembled to the upper portion of the apparatus main body 1 and thus they are not mounted and removed on the market.

However, when the expansionability of the sheet processing apparatus in the market is taken into consideration, preferably, the transport section 5 and the eject section 6 are detachably disposed.

Here, the transport section 5 may be mounted on the main body stack section 4 when expanding the system of the sheet processing apparatus (for example, when attaching the postprocessing apparatus to the sheet processing apparatus additionally). The transport section 5 must include a transport passage for transporting the sheet S ejected from the eject opening of the main body discharge section 3 in a sheet eject direction (normally, toward the side where postprocessing apparatus 10 is disposed) on the upper portion of the main body stack section 4, and a proper number of transport members disposed in this transport passage.

Also, the eject section 6 may be mounted on the upper portion of the main body discharge section 3 when expanding the system of the sheet processing apparatus. And, the eject section 6 must include a second eject passage different from the eject passage of the main body discharge section 3 and, in the vicinity of the eject opening of the second eject passage, eject members such as a pair of eject rollers.

In this case, the second eject passage of the eject section 6 may be a eject passage which branches from the intermediate portion of the eject passage of the main body discharge section 3, or it may be a eject passage which is formed separately from and independently of the eject passage of the main body discharge section 3.

Further, the eject section 6 may further include a switching section 6*a* for switching the eject passage of the main body discharge section 3 and the eject passage of the eject section 6 over to each other.

In this structure, there is normally employed a system in which the switching section 6*a* is previously combined on the eject section 6 side. However, as a part of the eject section 6, the switching section 6*a* may also be combined on the main body discharge section 3 side.

Since the sheet processing apparatus according to the invention is based on the prerequisite that the main body stack section 4 and main body discharge section (the upper portion of the apparatus main body 1) are used as they are, the transport section 5 and an eject section 6 are to be mounted without removing the upper portion of the apparatus main body 1.

According to the invention, in case where the eject section 6 is mounted separately, the second eject passage different from the eject passage of the main body discharge section 3 can be secured, which allows the eject passage to have the similar curvature to the main body discharge section 3. This allows the sheet processing apparatus to maintain its eject performance with respect to various kinds of sheets.

Further, the transport placement portion 7 is disposed on the upper portion of the transport section 5 for placing and storing therein the sheet S ejected from the eject section 6; and, the transport placement portion 7 is structured using a length L which corresponds substantially to the entire length of the transport section 5 (which is equivalent to the length dimension of the main body stack section 4).

In this case, the transport placement portion 7 may be formed integrally with the transport section 5 or may be structured on the upper portion of the transport section 5 separately therefrom.

Also, the invention is not limited to a sheet processing apparatus but the invention also relates to a sheet transporting device that can be used when expanding the system of the sheet processing apparatus.

In this case, according to the invention, as shown in FIG. 1, there is provided a sheet transporting device for use in a sheet processing apparatus having an image forming section 2 formed in the interior of an apparatus main body 1 and, in the upper portion of the apparatus main body 1, a main body discharge section 3 from which a sheet S with an image formed thereon is to be discharged, and a main body stack section 4 for placing and storing therein the sheet S ejected from the main body discharge section 4, the sheet transporting device comprising: a transport section 5 disposed on the upper portion of the main body stack section 4 for transporting the sheet S discharged from the main body discharge section 3 in a sheet eject direction on the upper portion of the main body stack section 4; and an eject section 6 disposed on the upper portion of the main body discharge section 3 for ejecting the sheet S with an image formed thereon through a second eject passage different from the eject passage of the main body discharge section 3, wherein, in the upper portion of the transport section 5, there is formed a transport placement portion 7 for placing and storing therein the sheet S ejected from the eject section 6.

DETAILED DESCRIPTION OF THE PREFERRED EMBODIMENTS

Now, description will be given below in detail of the invention with reference to the preferred embodiments of the invention respectively shown in the accompanying drawings.

First Embodiment

Figure 2:
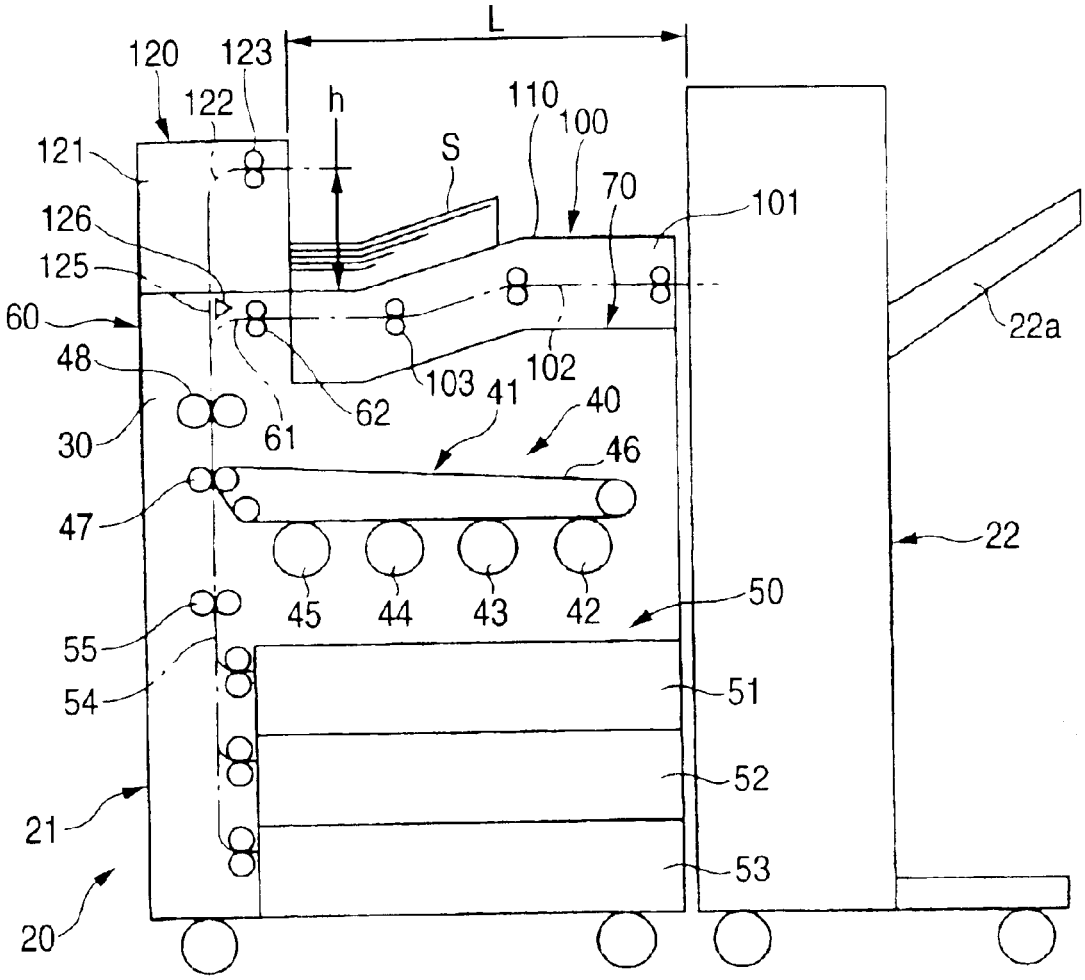
FIG. 2 is an explanatory view of the whole structure of a sheet processing apparatus according to a first embodiment of the invention.

FIG. 2 shows a general view of a first embodiment of a sheet processing apparatus according to the invention.

In FIG. 2, a sheet processing apparatus 20 comprises an image forming device 21 for forming an image on a sheet S and a postprocessing apparatus 22 disposed on the lateral side of the image forming device 21. As the postprocessing apparatus 22, for example, there is used an apparatus that incorporates a stapler therein.

Here, the image forming device 21 is structured in the following manner: that is, it includes an image forming section 40 in the interior of an apparatus main body 30; in the portion of the apparatus main body 30 that is situated below the image forming section 40, there is disposed a sheet supply portion 50; in the upper portion of the apparatus main body 30, there are disposed a main body discharge section 60 and a main body stack section (a main body eject tray) 70 for placing a sheet S discharged from the main body discharge section 60; and, after the image forming section 40 forms an image on the sheet S supplied from the sheet supply portion 50, the sheet S discharged from the main body discharge section 60 disposed in the upper portion of the apparatus main body 30 is placed and stored into the main body stack section 70.

In the present embodiment, the image forming section 40 includes, for example, an intermediate-transfer-type image forming module 41 of an electrophotgraphic type; and, the sheet S, to which an image has been transferred by the image forming module 41, is passed through a fixing device 48 and thus the image on the sheet S is fixed by the fixing device 48.

Here, referring to the structure of the image forming module 41, there are disposed four photosensitive drums 42–45 which are used to form the respective yellow, magenta, cyan and black images, in the peripheries of the respective photosensitive drums 42–45, there are disposed electrophotographic devices (not shown) (that is, a charging device, an exposure device, a primary transfer device, and a cleaning device), there is disposed an intermediate transfer belt 46 for the respective photosensitive drums 42–45, and, in part of the intermediate transfer belt 46, there is disposed a secondary transfer device (in the present embodiment, a secondary transfer roller) 47.

Further, the sheet supply portion 50 includes, for example, two or more stages of (in the present embodiment, three stages of) supply trays 51–53; and, the sheet S is fed out from any one of the supply trays 51–53. The sheet S fed out from the sheet supply portion 50 is once positioned by resist rollers 55 disposed in an upwardly extending transport passage 54 and, after then, the sheet S is passed through an image forming step executed by the image forming module 41 and a fixing step executed by the fixing device 48 and is then transported to the main body discharge section 60.

Also, the main body discharge section 60 includes a eject passage 61 curved in the horizontal direction from the transport passage 54 and eject rollers 62 respectively disposed in the vicinity of the eject opening of the eject passage 61.

Further, the main body stack section 70 is formed so as to be remaining areas of the upper portion of the apparatus main body 30 other than the main body discharge section 60. There is formed a height difference between the main body discharge section 60 side of the main body stack section 70 and the opposite side thereof, so that the rear end of the sheet S can be positioned in the vertical wall disposed between the main body stack section 70 and main body discharge section 60. Between the height different portions, there is interposed a gently inclined surface portion.

Figure 4:
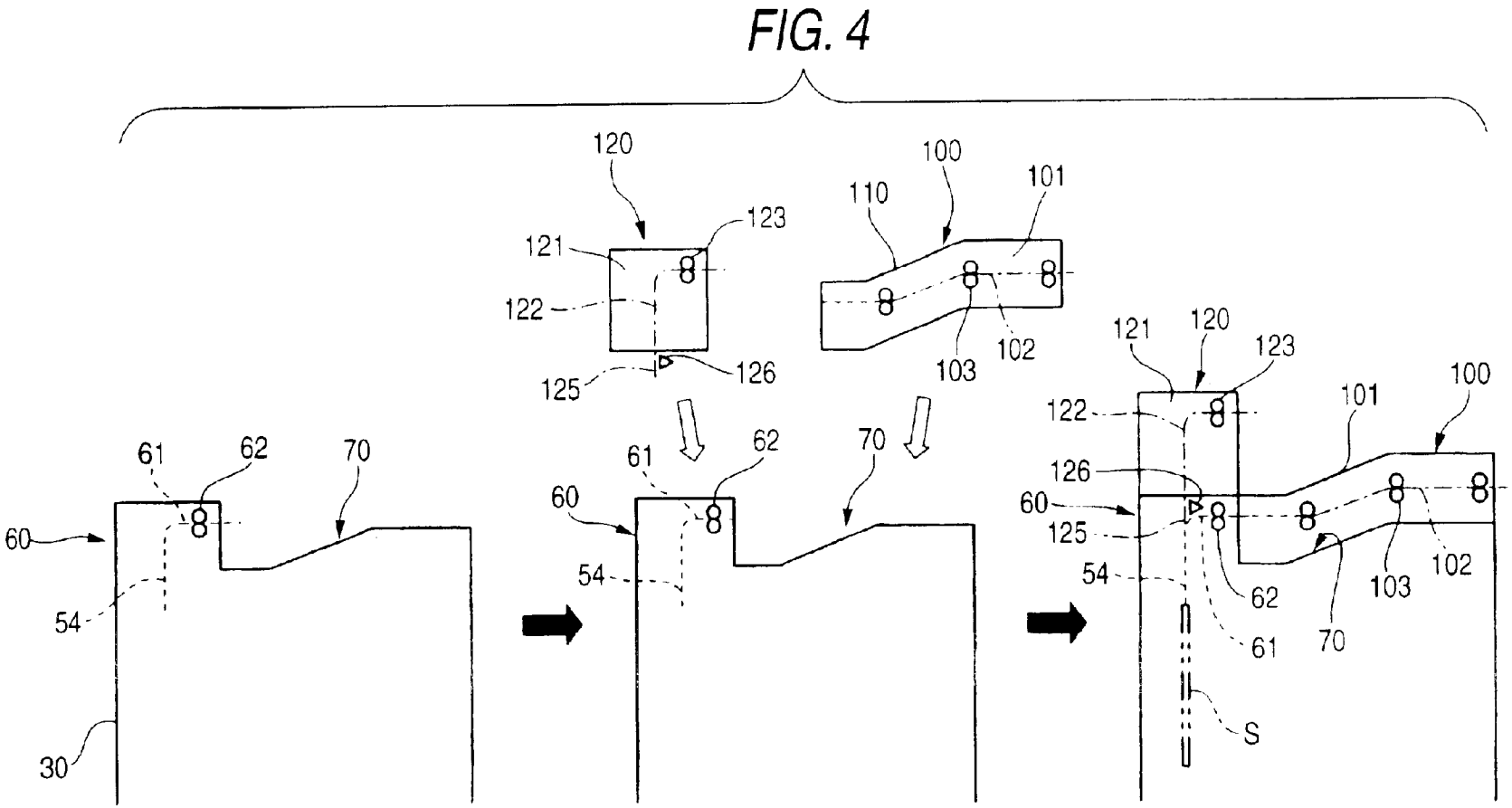
FIG. 4 is an explanatory view of a sheet transporting device used with the embodiment.

Especially, in the present embodiment, on the main body stack section 70, as shown in FIGS. 2 and 4, there is disposed a transport unit 100 structured in such a manner that it can be mounted onto and removed from the main body stack section 70.

The transport unit 100 includes a bottom surface that is similar in shape to the main body stack section 70. For example, the transport unit 100 is formed such that it is similar in height dimension to the main body discharge section 60 and it includes in the upper portion thereof a transport placement portion 110 formed similar in shape to the main body stack section 70.

And, the transport unit 100 includes, in the interior of the unit main body 101 thereof, a transport passage 102 for connecting together the eject opening of the main body discharge section 60 and the transport entrance opening of the postprocessing apparatus 22; and, in the transport passage 102, there are disposed a plurality of transport rollers 103 (in the present embodiment, three pairs of transport rollers) at given distances.

Also, on the upper portion of the main body discharge section 60, as shown in FIGS. 2 and 4, there is disposed a eject unit 120 structured in such a manner that it can be mounted onto and removed from the main body discharge section 60.

The eject unit 120 includes, in the interior of the unit main body 121 thereof, a eject passage 122 extending upwardly and curved in the horizontal direction, and eject rollers 123 respectively disposed in the vicinity of the eject opening of the eject passage 122.

Further, the eject unit 120 includes a connecting passage 125 for connecting together the curved-shaped eject passage 122 and the transport passage 54 formed in the interior of the apparatus main body 30, and a switching gate 126 formed in the vicinity of the connecting passage 125 for switching the eject passage 61 of the main body discharge section 60 and connecting passage 125 over to each other.

Figure 3:
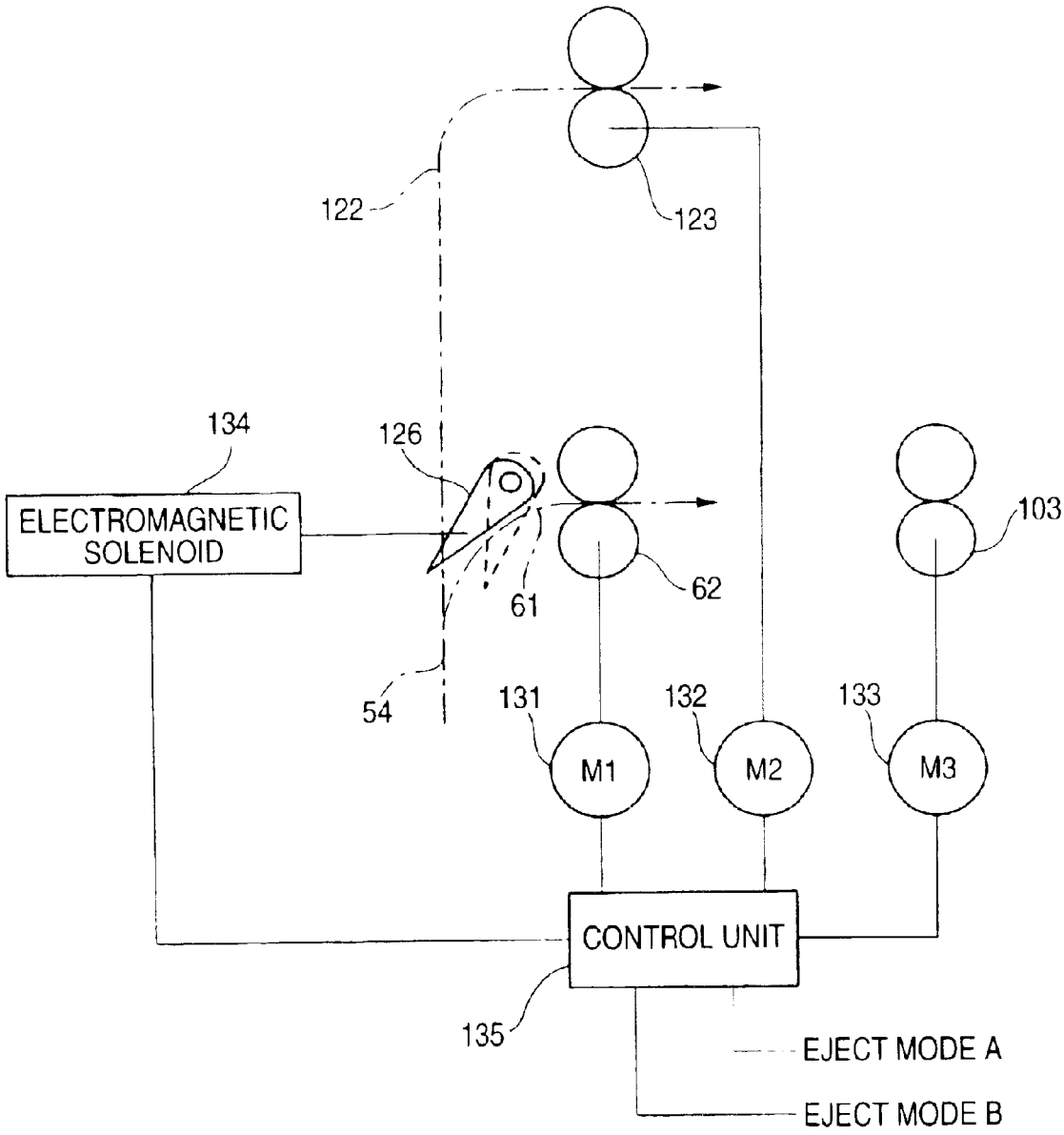
FIG. 3 is an explanatory view of a sheet transport control system according the embodiment.

Also, in the present embodiment, a drive control system for the main body discharge section 60 and eject unit 120 is arranged in such a manner as shown in FIG. 3.

In FIG. 3, reference character 131 designates a drive motor (in FIG. 3, M1) which is used to drive the eject roller 62 of the main body discharge section 60, 132 a drive motor (in FIG. 3, M2) for driving the eject roller 123 of the eject unit 120, 133 a drive motor (in FIG. 3, M3) for driving the transport rollers 103 of the transport unit 100, and 134 an electromagnetic solenoid for switching and operating the switching gate 126, respectively; and these drive elements 131–134 can be properly driven by a control signal output from a control unit 135.

Referring here to the function of the control unit 135, for example, in case where a eject mode A is selected, the control unit 135 executes a sheet eject operation using the eject unit 120; that is, the control unit 135 operates an electromagnetic solenoid 134 to allow the switching gate 126 to open its eject passage 122 side, and allows the drive motor 132 to drive and control the eject rollers 123.

On the other hand, in case where a eject mode B is selected, the control unit 135 executes a sheet transport operation using the transport unit 100; that is, the control unit 135 operates the electromagnetic solenoid 134 to allow the switching gate 126 to open its eject passage 61 side, and allows not only the drive motor 131 to drive and control the eject opening 62 but also the drive motor 133 to drive and control the transport rollers 103 of the transport unit 100.

Next, there is shown an example of the system expansion of a sheet processing apparatus according to the present embodiment.

The term "system expansion" used herein is not limited to the system expansion that is enforced on the market but contains provision of a system that is expanded when the sheet processing apparatus is shipped from a factory.

To take an example, let us consider a case in which the postprocessing apparatus 22 (see FIG. 2) is additionally combined with the sheet processing apparatus 20 including only the image forming device 21. As shown in FIG. 4, not only the transport unit 100 may be disposed on the main body stack section 70 of the apparatus main body 30 but also the eject unit 120 may be disposed on the main body discharge section 60.

According to the present embodiment, for example, as shown in FIG. 3, in case where the eject mode A is selected, the sheet eject operation by the eject unit 120 is executed; and, therefore, the sheet S, on which an image has been formed by the image forming section 40, is fed through the eject passage 122 of the eject unit 120 and is placed and stored in the transport placement portion 110 formed on the transport unit 100 by the eject roller 123.

At that time, since the transport placement portion 110, as shown in FIG. 2, has a length dimension substantially equal to the length dimension L of the main body stack section 70, there is no fear that the placeable sheet dimension is restricted.

Further, in case where the position of the eject opening of the eject unit 120 is set so as to be high to a certain degree, there can be secured a sufficiently large dimension h between the eject opening position of the eject unit 120 and transport placement portion 110, thereby eliminating a fear that the placement quantity of the sheets S is too small.

Still further, because the eject passage 122 of the eject unit 120 is curvedly formed with such curvature as substantially similar to that of the eject passage 61 of the main body discharge section 60, there is no possibility that the transport of a thick sheet can be impaired, so that the sheet S eject operation by the eject unit 120 can be executed regardless of the kinds of the sheets S.

On the other hand, in case where the eject mode B is selected, the sheet transport operation by the transport unit 100 is executed; and, therefore, the sheet S with an image formed thereon by the image forming section 40 is fed through the eject passage 61 of the main body discharge section 60, is guided to the transport unit 100 by the eject rollers 62, and is then transported along the transport passage 102 to the postprocessing apparatus 22 side by the transport rollers 103 of the present transport unit 100.

The sheet S, which has been transported into the postprocessing apparatus 22, receives a given postprocessing (for example, a stapling processing) and is then ejected to the eject tray 22*a* of the postprocessing apparatus 22.

Also, in the present embodiment, when expanding the system of the sheet processing apparatus, while the upper portion of the apparatus main body 30 of the image forming device 21 is used as it is, the transport unit 100 and eject unit 120 may be added, which makes it possible to realize the expansion of the apparatus system easily.

Figure 5:
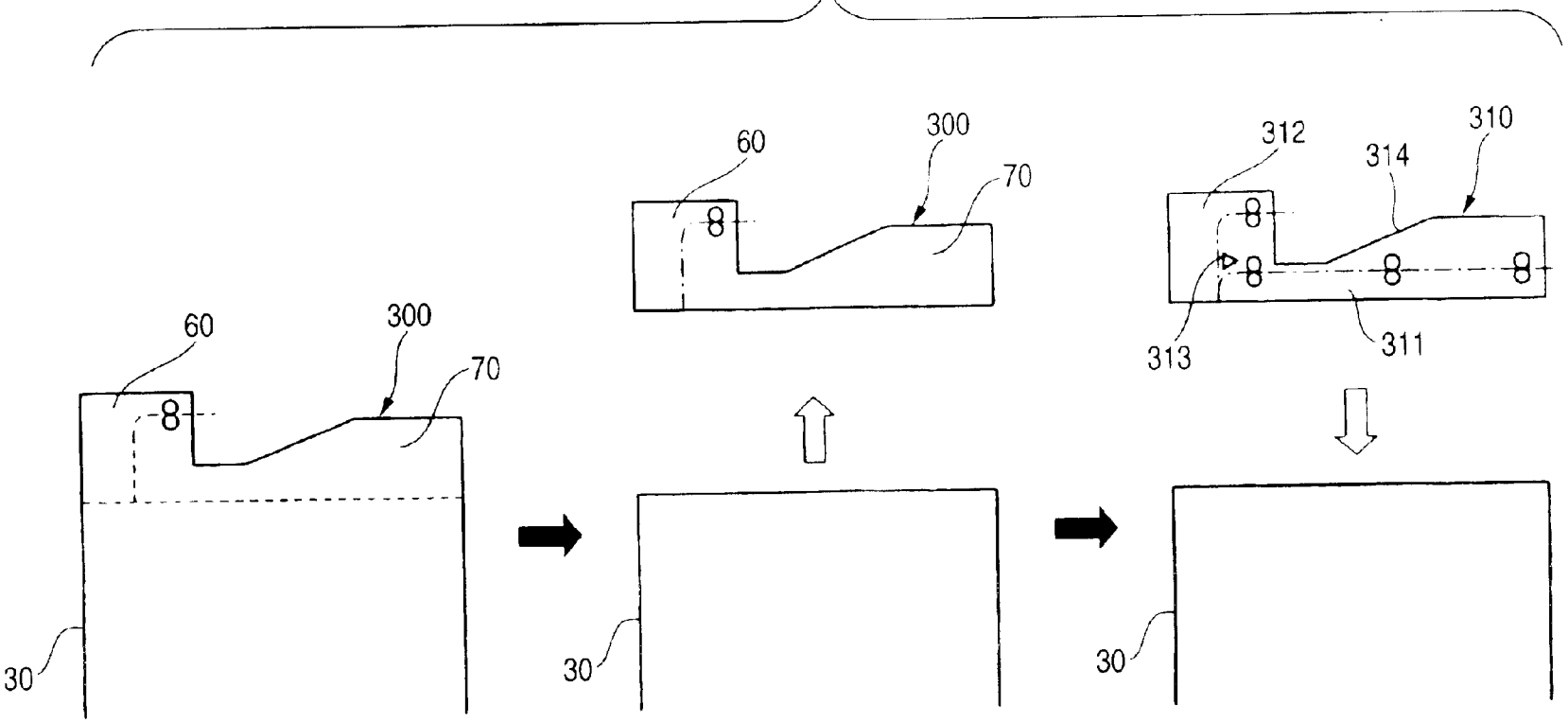
FIG. 5 is an explanatory view of a sheet transporting device used with a sheet processing apparatus according to a comparative example.
Figure 6:
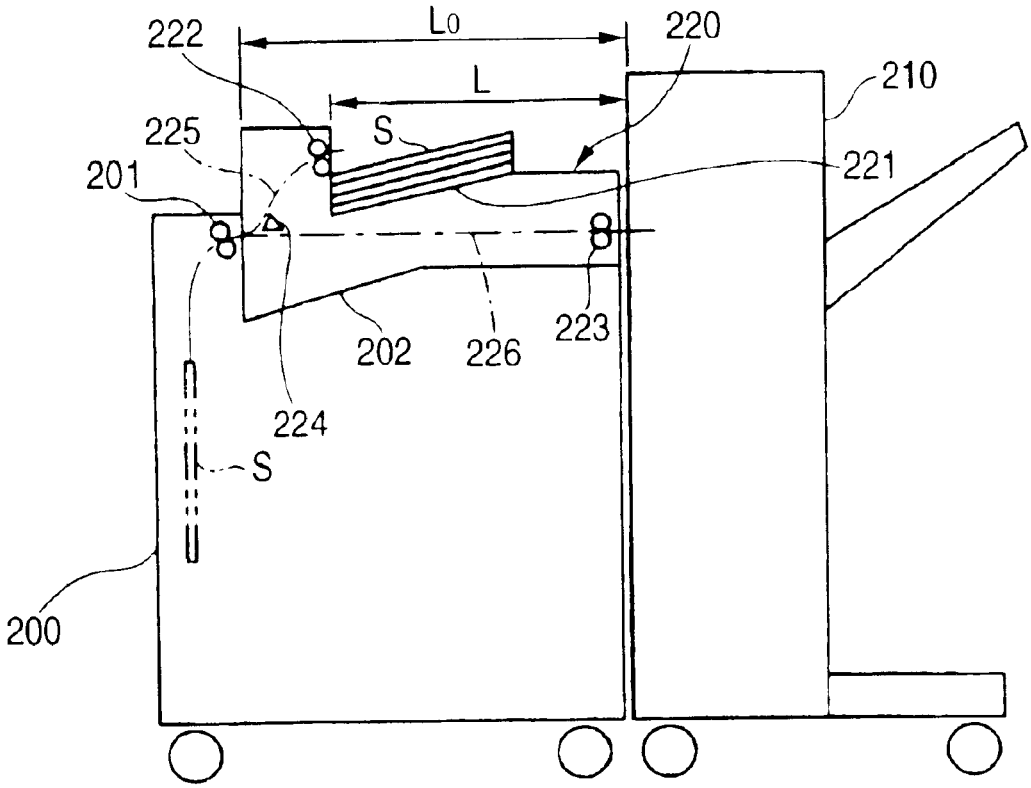
FIG. 6 is an explanatory view of an example of an expansion model of a conventional sheet processing apparatus.
Figure 7:
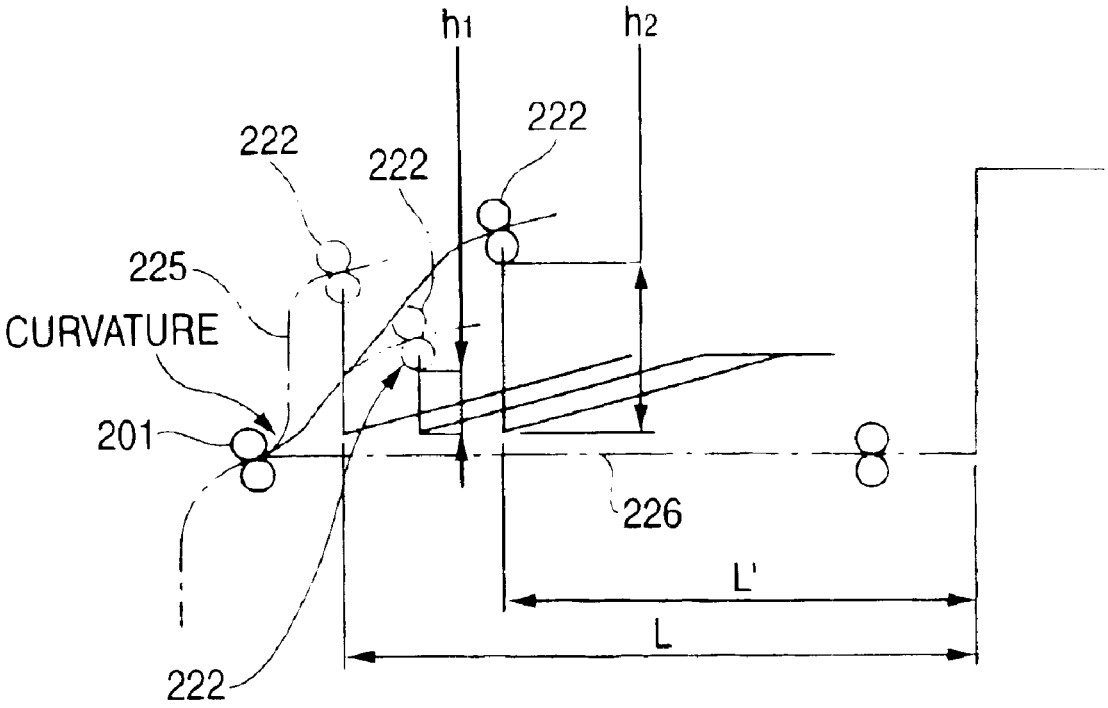
FIG. 7 is a typical view of the dimension relationships of the respective parts of the conventional sheet processing apparatus shown in FIG. 6.

On the other hand, in a comparative example shown in FIG. 5, the upper unit 300 of an apparatus main body 30 (an embodiment in which the main body discharge section 60 and main body stack section 70 are formed as an integrated body) is structured such that it can be freely mounted onto and removed from the apparatus main body 30; and, after the upper unit 300 is removed, an upper unit 310 with a separate transport portion integrally incorporated therein (an embodiment in which there is included a transport portion 311 in the interior thereof, a main body discharge section 312 and transport portion 311 are branched off from each other by a switching gate 313, and a sheet ejected from the main body discharge section 312 is placed and stored in a main body stack section 314) can be replaced. However, in the comparative example, since the upper portion structure of the apparatus main body 30 cannot be used as it is, the expansion of the apparatus system is complicated accordingly. That is, the embodiment of the invention is advantageous over the comparative example in that the expansion of the apparatus system can be executed easily.

As has been described heretofore, according to the sheet processing apparatus of the invention, when expanding the apparatus system such as a case in which a processing apparatus is added to the sheet processing apparatus, using the upper portion structure of the apparatus main body as it is, the eject section is disposed on the upper portion of the main body discharge section, and the transport placement portion is disposed on the upper portion of the transport section. Thanks to this, there can be provided the following technical effects.

Firstly, since the transport placement portion having a length dimension substantially the same as the main body stack section can be secured on the upper portion of the transport section, not only sheet transport by the transport section is possible but also a sufficient placeable sheet length dimension in the transport placement portion can be secured with no restrictions.

Secondly, because the eject section is disposed on the upper portion of the main body discharge section and the sheet is ejected through the eject section to the transport placement portion having a length dimension substantially the same as the main body stack section, as the eject passage of the eject section, there can be secured a eject passage having such curvature as substantially identical with that of the main body discharge section. Accordingly, the curvature of the eject passage need not be increased but a sufficient height dimension can be secured between the eject opening of the eject section and transport placement portion.

This can prevent a problem that a thick sheet cannot be transported, the sheet eject performance of the sheet processing apparatus can be maintained well regardless of the kinds of sheets, and the sufficient placement and storage quantity of eject sheets can be secured.

Thirdly, when expanding the system of the sheet processing apparatus, the upper portion structure of the apparatus main body can be used as it is and a sheet transporting device may be added newly as an option or as standard equipment. This makes it possible to expand the apparatus system easily without wasting the parts of the apparatus.

Also, according to the sheet transporting device of the invention, by using the sheet processing apparatus as it is before it is expanded, the system expansion of the sheet processing apparatus is possible. Thanks to this, the apparatus system expansion can be realized easily and at a low cost.

What is claimed is:

1. A sheet processing apparatus comprising:

an apparatus main body;

an image forming section disposed in the apparatus main body;

a main body discharge section, from which a sheet with an image formed thereon is discharged, disposed in the upper portion of the apparatus main body;

a main body stack section, in which the sheet discharged from the main body discharge section is placed and stored, disposed in the upper portion of the apparatus main body;

a transport section disposed on the upper portion of the main body stack section for transporting the sheet discharged from the main body discharge section in a sheet eject direction on the upper portion of the main body stack section;

an eject section disposed on the upper portion of the main body discharge section for ejecting the sheet with an image formed thereon through a second eject passage different from a eject passage of the main body discharge section, wherein the eject section includes a switching section for selecting one of the eject passage of the main body discharge section and the second eject passage; and a transport placement portion formed on the upper portion of the transport section for placing and storing therein the sheet ejected from the eject section.

2. A sheet processing apparatus according to claim 1, wherein a postprocessing apparatus for executing a predetermined postprocessing on the sheet transported by the transport section is disposed on the lateral side of the apparatus main body.

3. A sheet processing apparatus according to claim 1, wherein at least one of the transport section and the eject section is detachably mounted on the upper portion of the apparatus main body.

4. A sheet processing apparatus according to claim 1, wherein at least one of the transport section and the eject section is formed as a unit.

5. A sheet processing apparatus according to claim 1, wherein the upper portion of the main body stack section and the upper portion of the transport section are substantially identical in shape with each other.

6. A sheet processing apparatus comprising:

an apparatus main body;

an image forming section disposed in the apparatus main body;

a main body discharge section, from which a sheet with an image formed thereon is discharged, disposed in the upper portion of the apparatus main body;

a main body stack section, in which the sheet discharged from the main body discharge section is placed and stored, disposed in the upper portion of the apparatus main body;

a transport section disposed on the upper portion of the main body stack section for transporting the sheet discharged from the main body discharge section in a sheet eject direction on the upper portion of the main body stack section;

an eject section disposed on the upper portion of the main body discharge section for ejecting the sheet with an image formed thereon, wherein the eject section includes a switching section for selecting one of the eject passage of the main body discharge section and the second eject passage; and a transport placement portion formed on the upper portion of the transport section for placing and storing therein the sheet ejected from the eject section, wherein the allowable quantity of sheets to be placed in the transport placement portion is larger than that of the main body stack section.

7. A sheet transporting device to be mounted on a sheet processing apparatus having an apparatus main body; an image forming section disposed in the apparatus main body; a main body discharge section, from which a sheet with an image formed thereon is discharged, disposed in the upper portion of the apparatus main body; and a main body stack section, in which the sheet discharged from the main body discharge section is placed and stored, disposed in the upper portion of the apparatus main body, the sheet transporting device comprising:

a transport section disposed on the upper portion of the main body stack section for transporting the sheet discharged from the main body discharge section in a sheet eject direction on the upper portion of the main body stack section;

an eject section disposed on the upper portion of the main body discharge section for ejecting the sheet with an image formed thereon through a second eject passage different from a eject passage of the main body discharge section, wherein the eject section includes a switching section for selecting one of the eject passage of the main body discharge section and the second eject passage; and a transport placement portion formed on the upper portion of the transport section for placing and storing therein the sheet ejected from the eject section.

* * * * *